United States Patent [19]

Baugh

[11] Patent Number: 4,641,998

[45] Date of Patent: Feb. 10, 1987

[54] UNDERWATER CONNECTION APPARATUS

[76] Inventor: Benton F. Baugh, 14626 Oak Bend, Houston, Tex. 77079

[21] Appl. No.: 761,617

[22] Filed: Aug. 1, 1985

[51] Int. Cl.[4] ..... E21B 43/01

[52] U.S. Cl. ..... 405/169; 166/343; 166/338

[58] Field of Search ..... 405/168, 169, 170, 171; 166/338–347; 285/18, 24, 27

[56] References Cited

U.S. PATENT DOCUMENTS

| | | | |
|---|---|---|---|
| 3,886,667 | 2/1975 | Baugh | 166/343 X |
| 3,924,446 | 12/1975 | Baugh | 73/37 |
| 3,968,838 | 7/1976 | Baugh | 166/347 |
| 3,973,625 | 8/1976 | Baugh | 166/343 |
| 4,004,635 | 1/1977 | Marquaire et al. | 166/343 |
| 4,371,291 | 2/1983 | Morrill et al. | 405/169 |

OTHER PUBLICATIONS

"A Guideliness Tree and Flowline Connections Systems for Deepwater Production" by H. O. Henderson, paper No. 4251 at the Offshore Technology Conference.

"Deepwater Guildelineless Completion Systems: A review of the State of the Art" by Benton F. Baugh, presented at the Drilling and Production Symposium of the 1985 Energy-Sources Technology Conference and Exhibition.

*Primary Examiner*—Dennis E. Taylor

[57] ABSTRACT

A system for aligning and securing the end of a subsea flowline to a subsea wellhead and guide base system associated with an oil or gas completion system which provides for the manipulation of the centerline of pins on the subsea flowline end connection attachment, the centerline of receptacles on the flowline receiving structure, and a centerline on pulling tool guidance means to a concurrent location such that the pins can engage the receptacles and thereby the flowline end can be positively locked into the flowline receiving structure at varying vertical rotational positions of the end of the flowline and subsequently when a desired vertical rotational position or elevation of the flowlines is achieved other pins will engage other receptacles and lock the flowline end attachment and therefore the flowlines against further vertical movement.

10 Claims, 5 Drawing Figures

UNDERWATER CONNECTION APPARATUS

Oil and gas wells typically comprise downhole concentric pipes called casings and tubings, an arrangement of valves and fittings at the surface called a Christmas Tree, and flowlines which take the production away from the well or in some cases bring injection fluids or gases to the well. The remote attachment of these flowlines to a deepwater subsea Christmas Tree is a major difficulty in the drilling and completion oil and gas in offshore waters and this invention is directed at making this connection means more reliable and more flexible to accommodate the requirements of operators in the field.

For a flowline landing system of this type to be able to assist in a wide variety of applications in the field it should be able to 1. be run before or after the Christmas Tree is landed, 2. be able to be run and approach the sea floor completion system at any angle from vertical to horizontal, and 3. be the first end or the second end of the flowline to be connected.

Typical systems presently in the field differ widely in the ability to perform each of these characteristics with the most able generally being described in the U.S. Pat. Nos. 3,886,677, 3,924,446, 3,968,838, and 3,973,625. The system described in these patents will perform all of the indicated requirements and yet has the deficiency of requiring that the flowline be brought to a perfectly horizontal elevation prior to their being mechanically secured to the wellhead system.

Other systems such as the one described in the paper "A Guidelineless Tree and Flowline Connection System for Deepwater Production" by H. O. Henderson at the 1978 Offshore Technology Conference will connect the flowlines but is limited because it requires that the Christmas Tree not be in place when the flowlines are landed, it is limited in the number of flowlines which it can handle, it inherently requires the purchase of an extra high pressure wellhead connector, and will only allow the flowlines to be landed vertically. Other systems have varieties of the capabilities of the two systems mentioned, but none provides the capabilities of the present invention.

SUMMARY OF THE INVENTION

The object of the present invention is to provide a full strength mechanical lock with vertical angular freedom between the end of a flowline approaching a subsea wellhead and the subsea wellhead as soon as the flowline approaches irrespective of the vertical angular alignment of the flowline by providing that the centerline of circular attachment means on the end of the flowline be brought to a concentric position with circular receptacles on the flowline receiving structure by having a circular portion on the guidance means for the flowline end align with a circular portion on the flowline receiving structure and thereby provide immediate engagement.

BRIEF DESCRIPTION OF THE DRAWINGS

FIG. No. 1 is an overview of the application of this invention showing a subsea Christmas Tree landed on the ocean floor below a floating drill ship at the surface of the ocean, FIG. No. 2 is a top view section thru a flowline connection illustrating the specific mechanisms of this invention and as will be seen later is actually section "2—2" of FIG. 3, FIG. No. 3 is a partial view of a subsea Christmas Tree with the flowlines approaching the wellhead system and about to be landed, FIG. No. 4 shows the same view as in FIG. No. 3 with the flowlines actually landed in the flowline receiving structure, and FIG. No. 5 shows a top view of the flowline connection and Christmas Tree system of FIG. No. 4.

DESCRIPTION OF THE PREFERRED EMBODIMENT

Figures 1, 2:
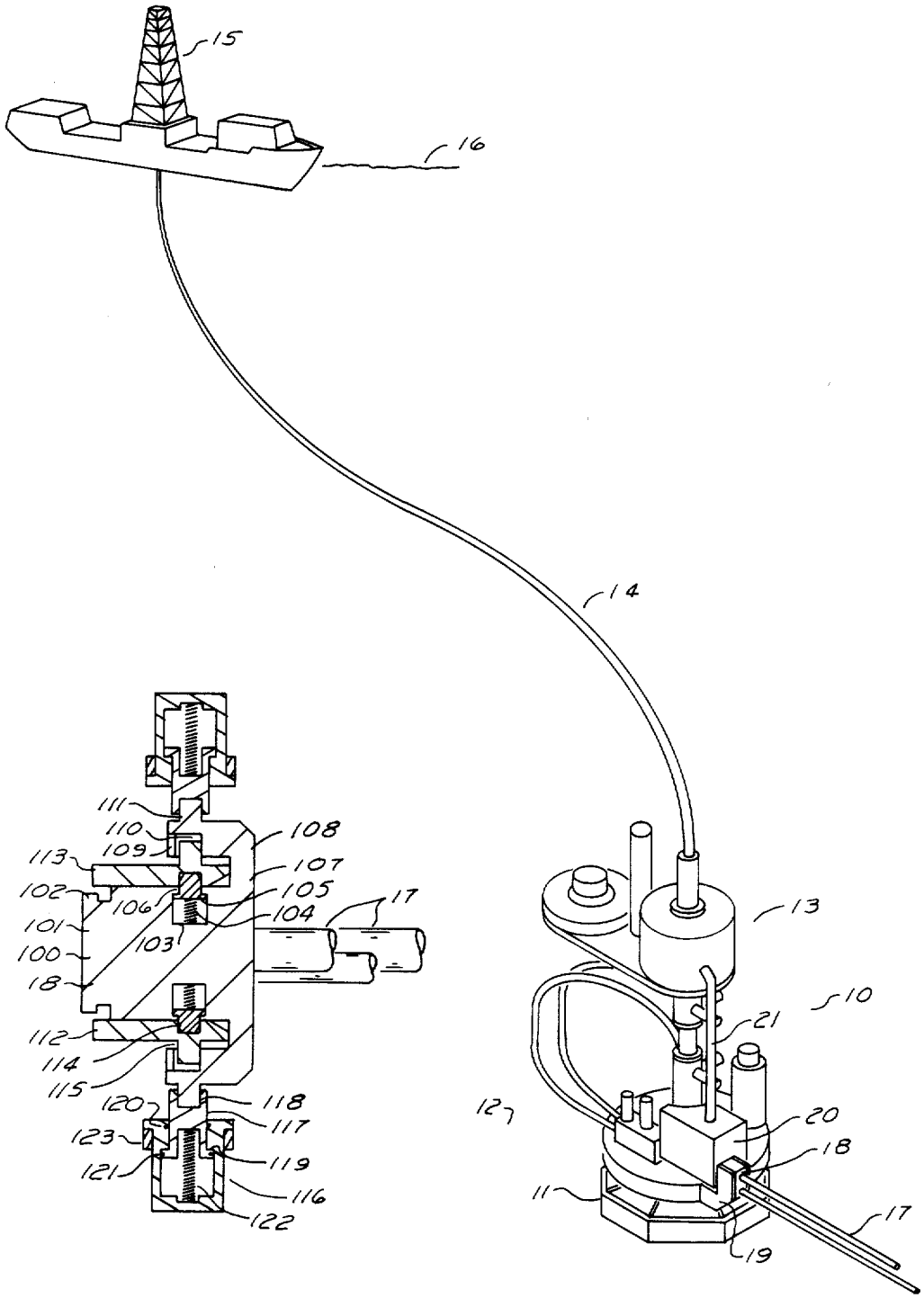

Referring now to FIG. 1, the Christmas Tree 10 is shown landed on a wellhead and landing base system 11 on the ocean floor 12. A tree running tool 13 is attached to the top of the Christmas Tree 10 and is connected to a running string of pipe 14 which goes up to a surface vessel 15 at the surface of the ocean 16 for purposes of running, retrieving, and servicing the Christmas Tree 10.

Flowlines 17 are shown along the ocean floor 12 and are attached with a sea floor flowline end connection 18 to a flowline receiving structure 19. A flowline pulling tool and nose assembly 20 is shown landed on the tree and connected back to the tree running tool 13 by a bracket 21. After the completion of the flowline landing and connection procedures, the flowline pulling tool assembly 20 will be automatically retrieved when the tree running tool 13 is retrieved.

FIG. 2 shows a top view section thru a sea floor flowline end connection 18 with the flowlines 17 attached on the right side. The drawing is symmetrical about the centerline of the flowlines, so when a part is described on one side of the centerline, it will apply as well to parts on the other side of the centerline.

The central portion 100 of the sea floor flowline end connection 18 is a large metal block suitable for porting as required for various flowline sizes and has a face area 101 on the left end for any suitable mechanical connection to be machined for attachment by any suitable mechanical connector. The particular lugs 102 illustrated are as would be used on a mechanical connector similar to the one shown in U.S. Pat. No. 3,924,446. A recess 103 is provided for spring 104 and spring loaded pin 105 behind a retaining shoulder 106. Extension arm portion 107 extends up (in this figure) and extension arm portion 108 extends to the left toward the face area 101. Extension arm portion 108 includes a funnel shaped area 109 opening toward the face area 101 and having a circular surface 110 at the rear of the funnel area. Projecting upwardly (in this figure) from the side of the extension arm portion 108 is a first round pin 111. The centerlines of the spring loaded pin 105, the circular surface 110, and the first round pin 111 are concurrent.

Flowline receiving structure 19 has side plates 112 and 113 which are symmetrical about the centerline of the flowlines. Holes 114 are provided for the insertion of spring loaded pins 105 and second round pins 115 are provided for the engagement by the cylindrical surfaces 110. The centerlines of the holes 114 and the second round pins 115 are concurrent such that when the cylindrical surfaces 110 on the sea floor flowline end connection 18 are brought against the second round pins 115, the spring loaded pins 105 automatically engage the holes 114.

Cylinder assemblies 116 are mounted on mechanisms to be described later for the purpose of bringing the sea floor flowline end connection 18 to the approximate position as presently shown in FIG. 2. Rod 117 provides a circular hole 118 for engagement of the first round pin 111 and provides an enlarged shoulder area 119 which is sealed by the seals 120 and 121. Pressure induced into the area between the seals 120 and 121 will cause the piston area to work against the spring 122 and disengage the rod 117 from the first round pin 111. Cylinder assembly 116 is attached to the mechanisms to be described later by a bracket 123. The purpose of the cylinders 116 is to provide a connection between the mechanisms to be described later and the sea floor flowline end connection 18 which can be forcefully brought into the position where each of the above described centerlines are concurrent while allowing vertical angular freedom of the flowlines until the pins 105 are firmly latched into the holes 114.

Figure 3:
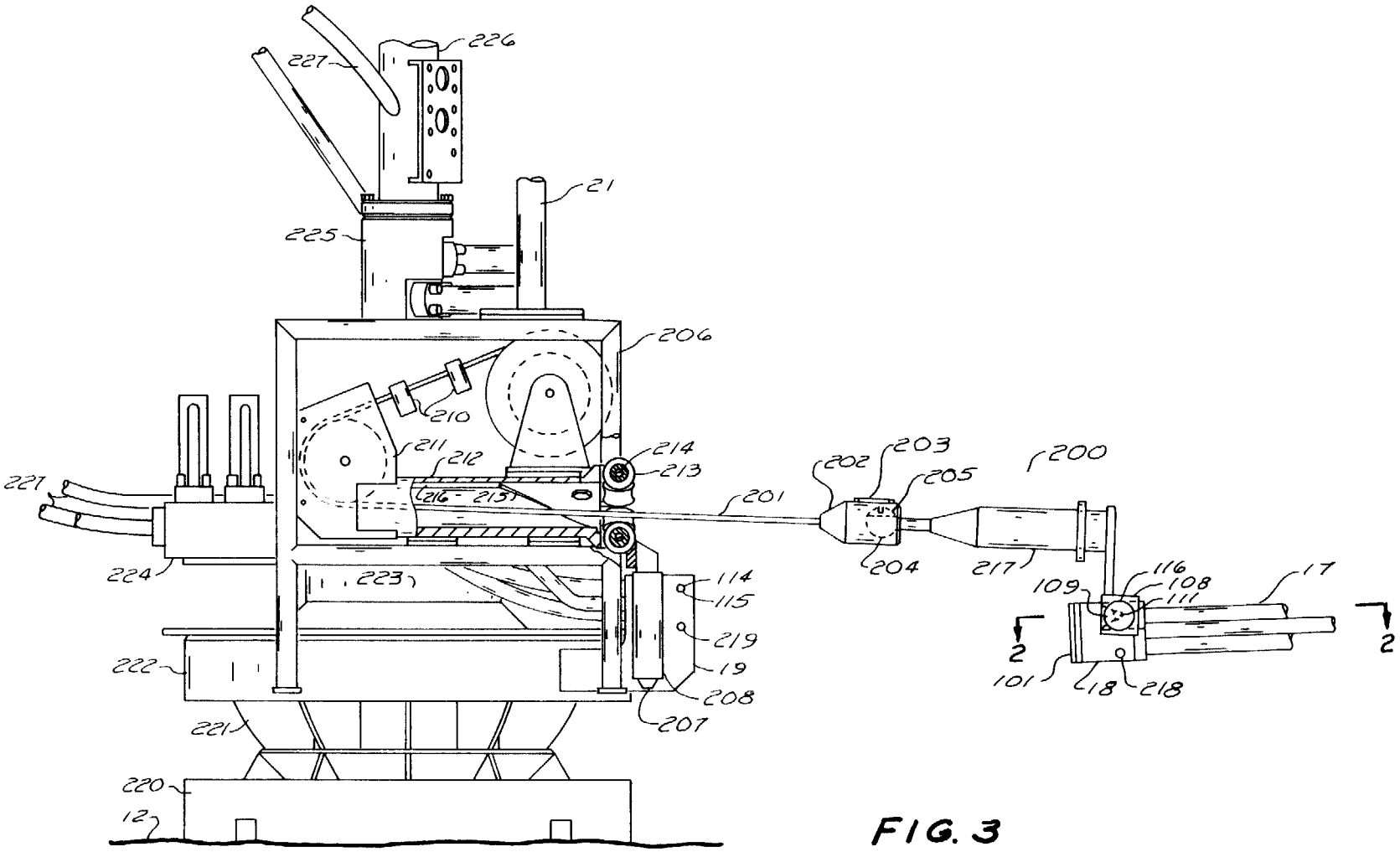

FIG. 3 shows the sea floor flowlines 17 attached to the sea floor flowline end connection 18 and shows the location where the FIG. 2 was taken along section "2—2". Face area 101, extention arm portion 108, funnel shaped area 109, first round pin 111, cylinder assembly 116, bracket 123, and second round pin 115 are labeled for orientatin of this figure to FIG. 2. A flowline nose assembly 200 which includes the bracket 123 and the cylinder assemblies 116 is a tool which is attached to the sea floor flowline end connection 18 and is pulled to the wellhead and landing base system 11 by a wire rope 201. The flowline nose assembly 200 includes a nose member 202 with an external key 203 and an internal ball joint 204 with a second key 205.

Flowline Pulling Assembly 206 is mounted on the wellhead and landing base system 11 by insertion of a prong 207 into a receptacle 208 on the flowline receiving structure 19. The flowline pulling assembly 206 provides a powered reel 209 for pulling in the wire rope 201, level wind rollers 210 to assist the wire rope in wrapping on the reel in an orderly manner, a turn around pulley assembly 211 to change the direction of the wire rope 201, and an alignment assembly 212.

The alignment assembly 212 provides 6 guiding rollers 213 on axles 214 at the open end to allow the flowline nose assembly 200 to enter the alignment assembly 212 with low friction, a mule shoe cam 215 to act with the external key 203 as the flowline nose assembly 200 enters the alignment assembly to bring the flowline nose assembly into a desired orientation. Slot 216 provides for a stroking travel of the nose assembly 200 after proper orientation has been established.

As the nose member 202 of the flowline nose assembly 200 enters the alignment assembly 212, orientation is established by the relationship of the external key 203 and the mule shoe cam 215. At this time the barrel portion 217 of the flowline nose assembly 200 contacts the guiding rollers 213 and further pull on the wire rope 201 causes the barrel portion 217 and therefore the flowline nose assembly 200 to be closely aligned within the guide rollers 213. This additionally causes the sea floor flowline end connection 18 to be closely aligned in all directions except the vertical angle.

As the flowline nose assembly 200 enters and is aligned by the alignment assembly 212, the funnel shaped area 109 and the circular surface 110 are brought into contact with the second pin member 115 thereby allowing the spring loaded pins 105 to engage the holes 114 even though the flowlines 17 are not at the final vertical angle. In this particular view the flowlines 17 are shown to be slightly elevated above horizontal, however this method will work equally as well for angles below horizontal to vertical.

Once the spring loaded pins 105 are in the holes 114, high laydown forces can be imparted on the flowlines 17 without the force being transmitted to the relatively weak wire rope 201. Additionally, when the flowline 17 is either lowered or raised to the horizontal position, spring loaded pins 218 will enter holes 219 and securely lock the sea floor flowline end connection 18 in its final position.

The temporary guide base 220, gimbal 221, permanent guide structure 222, wellhead connector 223, wing and crossover valves 224, master valve block 225, wye spool 226, and tree flowline loop portion 227 are parts of subsea completions well known in this art and further information can be seen in viewing the reference patents.

Figure 4:
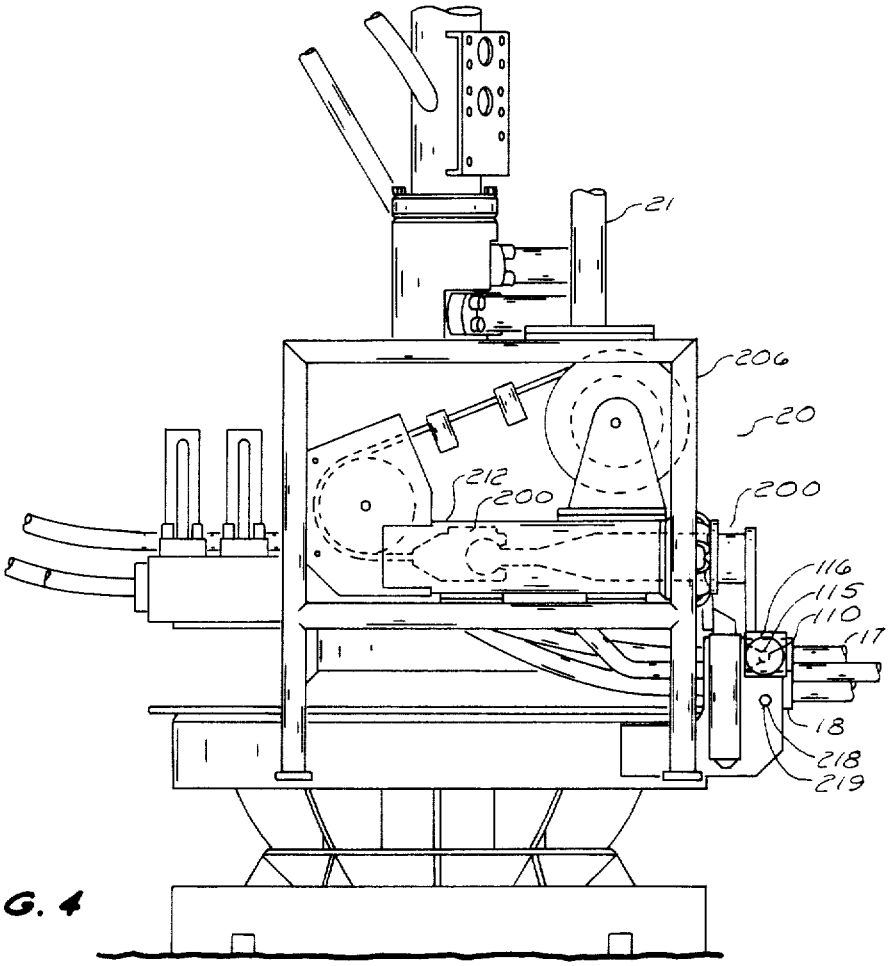

FIG. 4 shows the view of FIG. 3 with the flowline nose assembly 200 completely within the alignment assembly 210 and the circular surface 110 pulled against the second round pin 115, and therefore the spring loaded pins 105 are inserted into the holes 114. Additionally, the flowlines 17 have been brought to the horizontal position and so the spring loaded pins 218 are also inserted into the holes 219 to lock the sea floor flowline end connection in its final position.

Hydraulic (or other types of) power can now be applied to lock the actual flowline connection together, in accordance with whatever style mechanical connection is used. At this time the cylinder assemblies 116 can be released from the sea floor flowline end connection 18 and the flowline pulling tool and nose assembly 20 comprising the flowline pulling assembly 206 and the flowline nose assembly 200 can be retrieved to the surface using the bracket 21.

Figure 5:
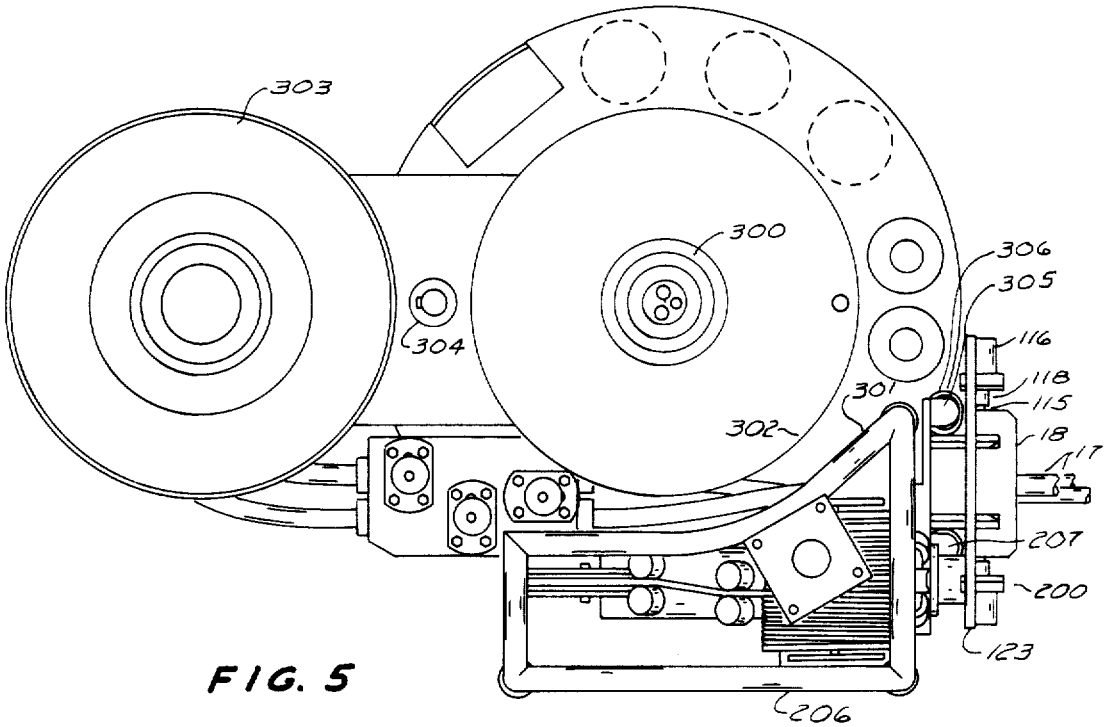

FIG. 5 shows a top view of the view in FIG. 4 showing the entire tree up to the top of the tree mandrel 300 which would be landed on by the tree running tool 13. In this sytle the frame 301 of the flowline pulling assembly 206 is contoured to clear the outer diameter of the tree top baseplate 302 which is mounted directly below the tree mandrel 300. A tree cap 303 is shown stored in a set back position ready to be moved to a position setting on the tree mandrel 300 by using the setback receptacle 304. Flowlines 17 can be seen attached to the sea floor flowline end connection 18. In addition to the prong 207 engaging the receptacle 208 for structural support, in this view the second prong 305 can be seen engaging the oblong receptacle 306 for orientation of the flowline pulling assembly 206.

The foregoing disclosure and description of this invention are illustrative and explanatory thereof, and various changes in the size, shape, and materials, as well as the details of the illustrated construction may be made without departing from the spirit of the invention.

I claim:

1. In a subsea system for the production of oil or gas from subsurface formations or the injection of liquids or gases into subsurface formations, a subsea system for landing and securing ocean floor flowlines to said system, comprising a flowline receiving structure having two side plates which are spaced apart, a first circular hole in each side plate on a first centerline, and a circular projection on each side plate about said first centerline;

a flowline end connection suitable for attaching directly to the flowlines before the flowlines are lowered into the water including a first spring loaded pin on each side of the flowline end connection on a second centerline with said second centerline being at right angles to the centerline of said flowlines, a funnel shaped means with a cylindrical stop surface at the bottom of said funnel shaped area on each side of said flowline end connection with said cylindrical stop surface about said second centerline, and circular fixed pin members on each side of said flowline end connection for attachment of pulling tool means also about said second centerline;

a pulling tool means with a guidance nose means including attachment means for engaging said circular fixed pin members and a connection to a wire rope or the such like, a receptacle means for receiving and positioning said guidance nose means, and a wire rope means which can be tensioned to pull said guidance nose means toward and into said receptacle means;

said attachment means including cylinder assemblies about a third centerline with a piston means with a rod portion with a recess, a spring to urge said piston means to an extended position, and a piston area to retract said piston to a retracted position when pressured; said recess fitting over said circular fixed pin members in said extended position and retracted away from said circular fixed pin members in said retracted position such that when said guidance nose means is attached to said flowline end connection said third centerline is concurrent with said second centerline;

said pulling tool means provides alignment means for said guidance nose means as said guidance nose means is pulled into said receptacle means including a key member and a guidance diameter on said guidance nose and a helical cam and a roller guidance diameter formed by rollers on said receptacle means such that when said guidance nose means is drawn into said receptacle means by said wire rope said key member works with said helical cam and said guidance diameter works with said roller guidance diameter such that said third centerline and therefore said second centerline is brought into a concurrent position with said first centerline as said funnel shaped means and said cylindrical stop surface engages said circular projection allowing said first spring loaded pins to engage said first circular holes in said side plates thereby providing a fixed connection between said flowline receiving structure and said flowline end connection which can be made at varying angles of said flowlines and still allows a vertical angular degree of freedom for said flowlines;

said side plates each also having a second circular hole about a fourth centerline parallel but spaced apart a fixed distance from said first centerline and said flowline end connection having a second spring loaded pin members on each side of the flowline end connection on a fifth centerline parallel but spaced apart said fixed distance from said second centerline such that when said flowline end connection is brought to the horizontal elevation, said second spring loaded pin members will engage said second circular holes and lock said flowline end connection and therefore said flowlines from vertical movement.

2. In a subsea system for the production of oil or gas from subsurface formations or the injection of liquids or gases into subsurface formations, a subsea system for landing and securing ocean floor flowlines to said system, comprising:

a flowline receiving structure having side plates which are spaced apart, a first hole in each side plate on a first centerline, and a projection with a first stop surface on each side plate about said first centerline;

a flowline end connection suitable for attaching directly to the flowlines before the flowlines are lowered into the water including a first pin on each side of the flowline end connection on a second centerline with said second centerline being disposed at approximately right angles to the centerline of the flowlines, a funnel shaped means with a second stop surface at the bottom of said funnel shaped means on each side of said flowline end connection with said second stop surface about proximate said second centerline.

such that when said funnel shaped means is guided onto said projections on said side plates and said second stop surface contacts said first stop surface said second centerline is aligned with said first centerline and therefore said first pins can be inserted into said first holes, thereby providing a connection between said flowline end connection and said flowline alignment structure.

3. The invention of claim 2, wherein said flowline receiving structure includes a recess in one or both of said side plates spaced apart a distance from said first holes and said flowline end connection contains one or more projections engagable with said recesses for the purpose of fixing said flowline end connection into a fixed rotational position about said first centerline when said projections engage said recesses.

4. The invention of claim 3, wherein said first hole is a circular hole and said first pin is a circular pin.

5. The invention of claim 3, wherein said first pins are spring loaded into engagement with said first holes.

6. The invention of claim 3, wherein said first pin is circular and spring loaded into engagement with said first hole and where said recesses are circular holes and said projections are circular pins which are spring loaded into said recesses.

7. The invention of claim 3, wherein fixed pin members are provided about said second centerline on said flowline end connection for engagement by a pulling tool.

8. The invention of claim 7, wherein said fixed pin members are circular.

9. The invention of claim 8, wherein said first stop surface and said second stop surface are circular and about said first centerline and said second centerline respectively.

10. The invention of claim 9, wherein when said first spring loaded pins engage said first circular holes and said second pins engage said second circular holes said flowline end connection and therefore said flowlines will be disposed in approximately a horizontal position suitable for allowing said flowlines to lay along the ocean floor.

* * * * *